US008123074B2

(12) United States Patent
Luebbecke

(10) Patent No.: US 8,123,074 B2
(45) Date of Patent: Feb. 28, 2012

(54) APPARATUS FOR APPLYING FLUIDS SUCH AS ADHESIVE

(75) Inventor: Kai Luebbecke, Wittorf (DE)

(73) Assignee: Nordson Corporation, Westlake, OH (US)

( * ) Notice: Subject to any disclaimer, the term of this patent is extended or adjusted under 35 U.S.C. 154(b) by 896 days.

(21) Appl. No.: 12/028,200

(22) Filed: Feb. 8, 2008

(65) Prior Publication Data

US 2008/0190965 A1 Aug. 14, 2008

(30) Foreign Application Priority Data

Feb. 9, 2007 (DE) ..... 20 2007 002 156 U

(51) Int. Cl.
*B67D 3/00* (2006.01)

(52) U.S. Cl. ..... 222/47; 222/146.5; 222/334; 222/380; 427/207.1; 156/578; 118/315

(58) Field of Classification Search .... 222/146.1–146.2, 222/146.4–146.5, 380–381, 482–486, 333–334, 222/41–50; 118/300, 323–325, 313–315; 239/75, 133, 135, 563, 550; 156/578; 427/207.1
See application file for complete search history.

(56) References Cited

U.S. PATENT DOCUMENTS

| | | | | |
|---|---|---|---|---|
| 2,112,759 | A * | 3/1938 | Boyer | 118/308 |
| 3,233,583 | A * | 2/1966 | Neal et al. | 118/411 |
| 4,681,242 | A * | 7/1987 | Sirkin | 222/41 |
| 5,305,955 | A * | 4/1994 | Smitherman et al. | 239/75 |
| 5,647,948 | A * | 7/1997 | Paridis | 156/578 |
| 6,358,322 | B1 * | 3/2002 | Pahl | 118/680 |
| 6,689,214 | B2 * | 2/2004 | Burmester et al. | 118/300 |
| 2006/0131344 | A1 * | 6/2006 | Brass | 222/390 |
| 2008/0134966 | A1 * | 6/2008 | Luebbecke et al. | 118/300 |

FOREIGN PATENT DOCUMENTS

| | | | |
|---|---|---|---|
| DE | 4130432 | A1 | 3/1993 |
| DE | 10253410 | A1 | 1/2004 |
| DE | 20308257 | U1 | 9/2004 |
| DE | 202006014743 | U1 | 11/2006 |
| WO | 00/67914 | A2 | 11/2000 |
| WO | 2004/103577 | A1 | 12/2004 |

OTHER PUBLICATIONS

European Patent Office, European Search Report in EP 08100196, Aug. 20, 2008.

* cited by examiner

*Primary Examiner* — Kevin P Shaver
*Assistant Examiner* — Andrew Bainbridge
(74) *Attorney, Agent, or Firm* — Wood, Herron & Evans, L.L.P.

(57) ABSTRACT

A dispenser of viscous fluid, in at least one embodiment a hot melt glue adhesive, has a heater element, an adhesive source, a main common passage, and a series of valves that all fluidly connect to the main passage. A sheet of receiving material, such as an envelope, has hot melt glue applied to its surface as it passes under the series of valves. A variable amount of valves can be activated by moving control rods inwardly or outwardly of the main common passage. The moving control rods have indicator markers, a securing screw and are housed in U-shaped beds which collectively make adjusting the dispensing pattern very easy.

10 Claims, 7 Drawing Sheets

APPARATUS FOR APPLYING FLUIDS SUCH AS ADHESIVE

The present application claims the priority of German Utility Model Application No. 202007002156.9 filed Feb. 9, 2007 under 35 U.S.C. §119. The disclosure of that priority application is hereby fully incorporated by reference herein.

TECHNICAL FIELD

The present invention generally relates to apparatus for applying fluids such as adhesive to a substrate movable relative to the apparatus.

BACKGROUND

Utility model specification DE202006014743U1 discloses an apparatus in which a length of a distributor passage, which can be acted upon with fluid, is varied with a closure body driven by way of a drive device. Drive devices which are typically used have a holding device, a screwthreaded spindle mounted in the holding device, a screwthreaded body and a guide rod for the screwthreaded body. The screwthreaded body is displaced along the guide rod by rotation of the screwthreaded spindle. The screwthreaded body is connected in positively locking relationship to the closure body, whereby the movement of the screwthreaded body is transmitted to the closure body.

In a first limit position the closure body is pushed to a minimum distance into the distributor passage and the screwthreaded spindle projects over almost the entire length out of the nozzle arrangement. In a second limit position, that is, in a position in which the length of the distributor passage and the nozzle opening is at its smallest, the closure body is pushed into the distributor passage by the maximum extent. In order to ensure mobility of the closure body between those two limit positions, the screwthreaded spindle must be at least as long as the part of the closure body that projects out of the distributor passage, when the closure body is in the first limit position. As the screwthreaded spindle must be supported and requires an engagement portion at its end remote from the distributor passage so that it can be rotated, additional structural space is required for the drive device. The drive device not only requires structural space in line with the longitudinal axis of the distributor passage but also in radial relationship therewith, in particular for the holding device for mounting the screwthreaded spindle. The fact that a relatively large amount of structural space is required for the drive unit of the closure body can have a disadvantageous effect. Thus, the extent of the drive device in the longitudinal direction of the closure body can be detrimental as the drive device can collide with adjoining machines such as labelling machines or can collide with walls of a room.

Therefore the object of the invention is to provide an apparatus which makes it possible for the applicator apparatus to be of a more compact structure but at the same time does not adversely affect the displaceability of the closure body.

SUMMARY

In one aspect, the invention provides a closure body that can be fixed in various positions by a fixing device. The fixing device performs the fixing function for the closure body. By virtue thereof a drive device, which moves the closure body, can be separated from the closure body without the closure body being able to move. Therefore, in the operating condition in which the fixing device fixes the closure body, the structural space occupied by the apparatus can be reduced, and this is advantageous in certain installation or operating situations.

The invention is distinguished in that the closure body may, for example, be a piston rod or may be movable by means of a piston rod. Piston rods are particularly well suited for sealing off a cylindrical passage or for displacement of a closure body fixed to the piston rod when the length thereof, that can be acted upon with fluid, is to be quickly and easily altered.

In accordance with a further aspect, the fixing device is in the form of a clamping device. The clamping device makes it possible to selectively enable or prevent the movement of the piston rod along the longitudinal axis of the distributor passage, reliably and at a relatively low level of structural complication and expenditure.

In another aspect, the clamping device includes a housing and a clamping element which is movable therein by means of a clamping screw and which embraces the piston rod. This provides a clamping device which is of a compact and simple structure and inexpensive to manufacture.

In another aspect, the clamping device is releasably connectable to the nozzle arrangement and/or the main body. The nozzle arrangement which is used as standard and/or the main body only have to be modified in such a way that the clamping device can be secured to them. Such a modification can involve the provision of screwthreads for screws, which would signify only minor interventions. No special manufactures of main bodies and/or nozzle arrangements are required for that purpose. In addition there is the advantage that the clamping device can be quickly assembled and rapidly replaced in the event of failure. The nozzle arrangement does not have to be separated from the main body for that purpose.

A further development provides that the drive device includes a holding device, a screwthreaded spindle mounted therein, a screwthreaded body, a guide rod and/or a latching engagement element. A drive device of such a structure manages without complicated, expensive parts which are susceptible to trouble. The individual elements involved are mass-produced items which are quickly available and inexpensive. The drive device according to the invention can be quickly assembled and dismantled again in a simple fashion. There is no need for special tools or especially trained operating personnel.

Preferably the individual parts of the drive device form an interconnected unit and are connectable as a whole releasably to the main body and/or the nozzle arrangement and the piston rod. Assembly and dismantling are further facilitated by virtue of that configuration of the drive device. The drive device can be completely assembled before it is mounted to the main body and/or to the nozzle arrangement. The same thing also applies to the situation where the drive unit is to be removed. That is advantageous insofar as the stoppage times of the applicator apparatus can be kept short, which in turn affords economic advantages.

It is further preferred if the drive device can be fixed with only one fixing element, in particular a screw to the main body and/or to the nozzle arrangement. By virtue of that design configuration the drive device can be even more quickly fitted to the main body and/or the nozzle arrangement and released again. The amount of time necessary for that purpose is further reduced.

In accordance with a further aspect of the invention the latching engagement element co-operates with the screwthreaded spindle in such a way that the piston rod is discontinuously displaceable in each case by the spacing of two adjacent mutually spaced outlet passages. Such a design configuration is preferred for the situation where the nozzle opening communicates with the distributor passage by means of a plurality of mutually spaced outlet passages and the fluid flow through the outlet passages can be selectively enabled or interrupted by means of the piston rod and the length of the distributor passage which can be acted upon with fluid is stepwise variable. The latching engagement element assists the operator who rotates the screwthreaded spindle in displacing the piston rod into the correct position in the distributor passage in order to prevent an outlet passage being only partially closed by the piston rod, which would have a detrimental effect on the pattern of adhesive applied to the substrate.

In a preferred configuration of the invention the piston rod has markings, the spacing of which corresponds to the spacing of two adjacent outlet passages. That configuration also relates to the situation where the nozzle opening communicates with the distributor passage by means of a plurality of mutually spaced outlet passages. The markings serve as a means for checking that the piston rod is in the correct position in the distributor passage and also that the latching engagement element and the screwthreaded spindle are correctly co-operating. In addition in that respect the markings help to be able to better determine the position of the piston rod in the distributor passage. Thus the markings can be consecutively numbered, whereby information can be afforded about the number of outlet passages acted upon with fluid and thus about the width of the pattern with which the adhesive is applied to the substrate.

In accordance with a further aspect of the invention the nozzle opening communicates with the distributor passage by means of a continuous slot and the length, which can be acted upon with fluid, of the distributor passage and of the nozzle opening is steplessly variable by means of the piston rod and a projection which can be secured thereto. In comparison with the structure in which the nozzle opening communicates with the distributor passage by means of a plurality of outlet passages, it is possible in this case for the width of the applied pattern of adhesive to be adapted with a high level of accuracy to the individual specifications of the substrate to be worked upon.

It is further preferred if the drive device has a lateral projection relative to the main body, which can be oriented in the same direction or the opposite direction to the nozzle opening. That selection option means that account can be taken of the particular factors involved at the location of installation of the drive device and the applicator apparatus. One orientation of the lateral projection or the other may be preferred, depending on how the substrate is respectively moved in relation to the nozzle opening.

At least one holding element can be mounted on the same side or the opposite side of the main body as the nozzle opening and/or the lateral projection of the drive device.

At least one holding element can be mounted to the main body on the same side as the nozzle opening or on the opposite side to the nozzle opening.

It is further preferred if the lateral projection of the drive device can be mounted to the main body on the same side as the nozzle opening or on the opposite side to the nozzle opening.

That configuration can also provide that the arrangement of the applicator apparatus and the drive device can be individually adapted to the factors involved at the location of installation. In particular the spacing of the applicator apparatus and/or the drive device relative to the substrate can be enlarged thereby. There is a reduced probability of the substrate coming into contact with the drive device and/or the applicator apparatus and of the substrate being damaged or destroyed.

Aspects of the invention are described in greater detail hereinafter by means of embodiments by way of example illustrated in the drawings in which:

DETAILED DESCRIPTION

Figure 1A:
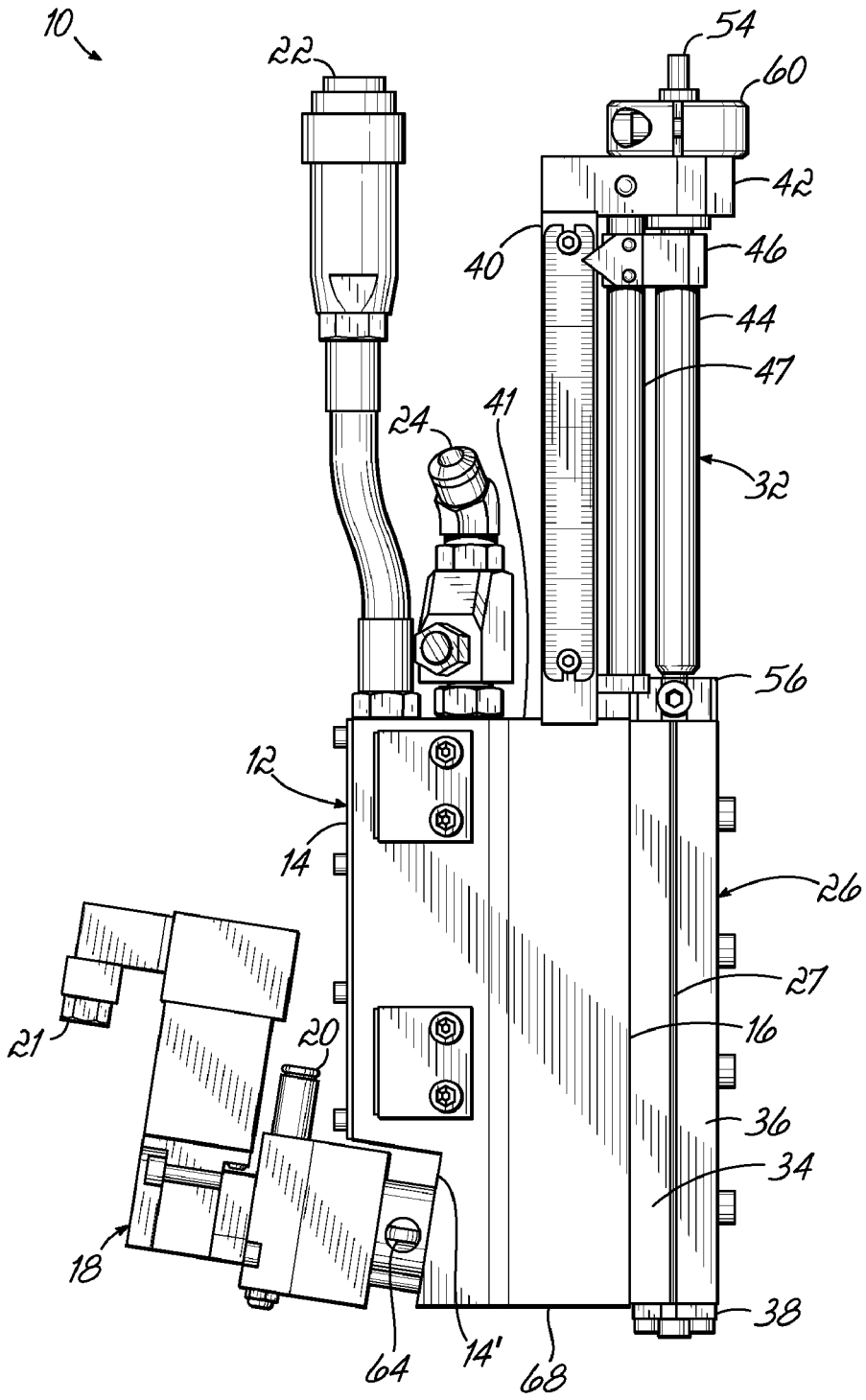
FIG. 1*a* is a side view of an applicator apparatus with a mounted drive device, the piston rod being in a first limit position.
Figure 1B:
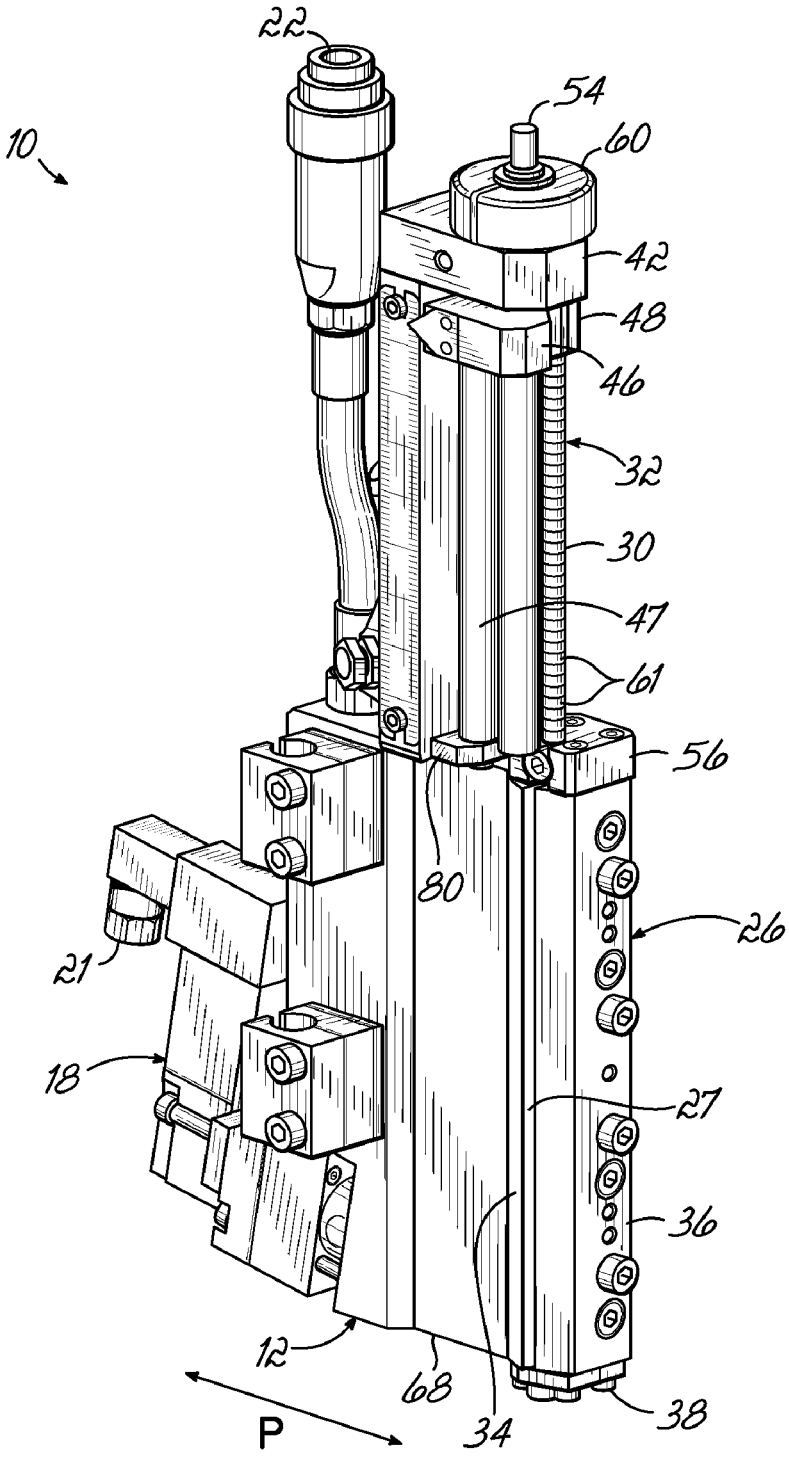
FIG. 1*b* is a perspective view of the applicator apparatus with a mounted drive device, the piston rod being in the first limit position.

The apparatus 10 shown in FIGS. 1*a* and 1*b* serve for applying fluids such as adhesive, in particular hot melt adhesive, to a substrate which is movable relative to the apparatus 10 in the direction of the arrow P. The structure in principle of the apparatus 10 corresponds to that of an apparatus known from DE202006014743 and the disclosure thereof is hereby incorporated by reference.

The apparatus 10 has a main body 12 with a first end face 14 and a second end face 16. On the first end face 14 an electropneumatically actuable valve 18 is connected to the main body 12. As illustrated in this embodiment the first end face can have a partial region 14' with an angular displacement in which the valve 18 is connected to the main body 12. The valve 18 has a compressed air connection 20 for a supply with compressed air and a connection 21 for supplying electrical power. The apparatus 10 has an electrical connection 22 for supplying a heating cartridge (not shown) with electrical power and a hose connection 24 which can be connected to a fluid source (not shown) for the supply of fluid. The flow of fluid through the main body 12 can be selectively enabled or interrupted by means of the valve and an intermittent application of adhesive can be effected by way of a nozzle arrangement 26 communicating with the main body 12. The nozzle arrangement 26 is connected to the main body 12 at the second end face 16 and includes a first partial block 34 and a second partial block 36 which form a substantially slot-shaped nozzle opening 27. A cylindrical distributor passage 28 (see FIG. 3) extends in the nozzle arrangement 26, with a piston rod 30 being arranged movably in the distributor passage 28. The piston rod 30 is displaceable in the distributor passage 28 by means of a drive device 32. In the illustrated embodiment at the end disposed in the distributor passage 28 the piston rod 30 has a closure body 31 which seals off the distributor passage 28. Alternatively, the closure body 31 can extend over the overall length of the piston rod 30. The distributor passage 28 can be delimited and sealed off laterally by the two partial blocks 34, 36 and at the end faces thereof by a sealing plate 38 with a seal (not shown) and by a sealing first end 39 of the piston rod 30.

The drive device 32 has a holding device 40, a mounting plate 42 screwed thereto, a screwthreaded spindle 44, a screwthreaded body 46, a guide rod 47 and/or a latching engagement element 60. The holding device 40 of the drive device 32 is connected to the main body 12 on a surface 41 by way of a securing portion 79. Alternatively, the holding device 40 can also be connected to the nozzle arrangement and/or the main body 12.

In the illustrated embodiment the mounting plate 42 is releasably connected in the form of a separate component to the holding device 40 but it can also be in the form of an integral constituent part of the holding device 40. A screwthreaded spindle 44 is mounted rotatably by means of plain or roller bearings (not shown) between the mounting plate 42 and the surface 41. The screwthreaded spindle 44 is connected to a screwthreaded body 46 which is supported displaceably on a guide rod 47 and which can be moved between the mounting plate 42 and the surface of the main body 12 along the longitudinal axis of the guide rod 47 by rotation of the screwthreaded spindle 44. The screwthreaded body 46 is releasably connected to the piston rod 30. In order to produce a connection which can be easily released, the screwthreaded body 46 has a recess 48 into which a portion 50 of the second end 52 of the piston rod 30 can be introduced, which is of a reduced diameter. The displacements of the screwthreaded body 46 in the direction of the longitudinal axis of the distributor passage 28 are transmitted from the screwthreaded body 46 to the piston rod 30 by positively locking engagement in the regions within which the diameter of the piston rod 30 is enlarged again at the two ends of the portion 50. The screwthreaded spindle 44 is actuated by rotation of the latching engagement element 60. Optionally the screwthreaded spindle 44 can be actuated by a suitable tool, for example a screw wrench, which is fitted on to an engagement portion 54 of the screwthreaded spindle 44. That option presents itself for the situation where the latching engagement element is not accessible or is only accessible with difficulty.

When the piston rod 30 is in the desired position, that is to say the desired length of the distributor passage 28 which can be acted upon with fluid is reached, the piston rod 30 is fixed in its position by means of a clamping device 56. That ensures that the piston rod 30 is not displaced even when fluids such as hot melt adhesive are conveyed under high pressure through the distributor passage 28.

Figure 2:
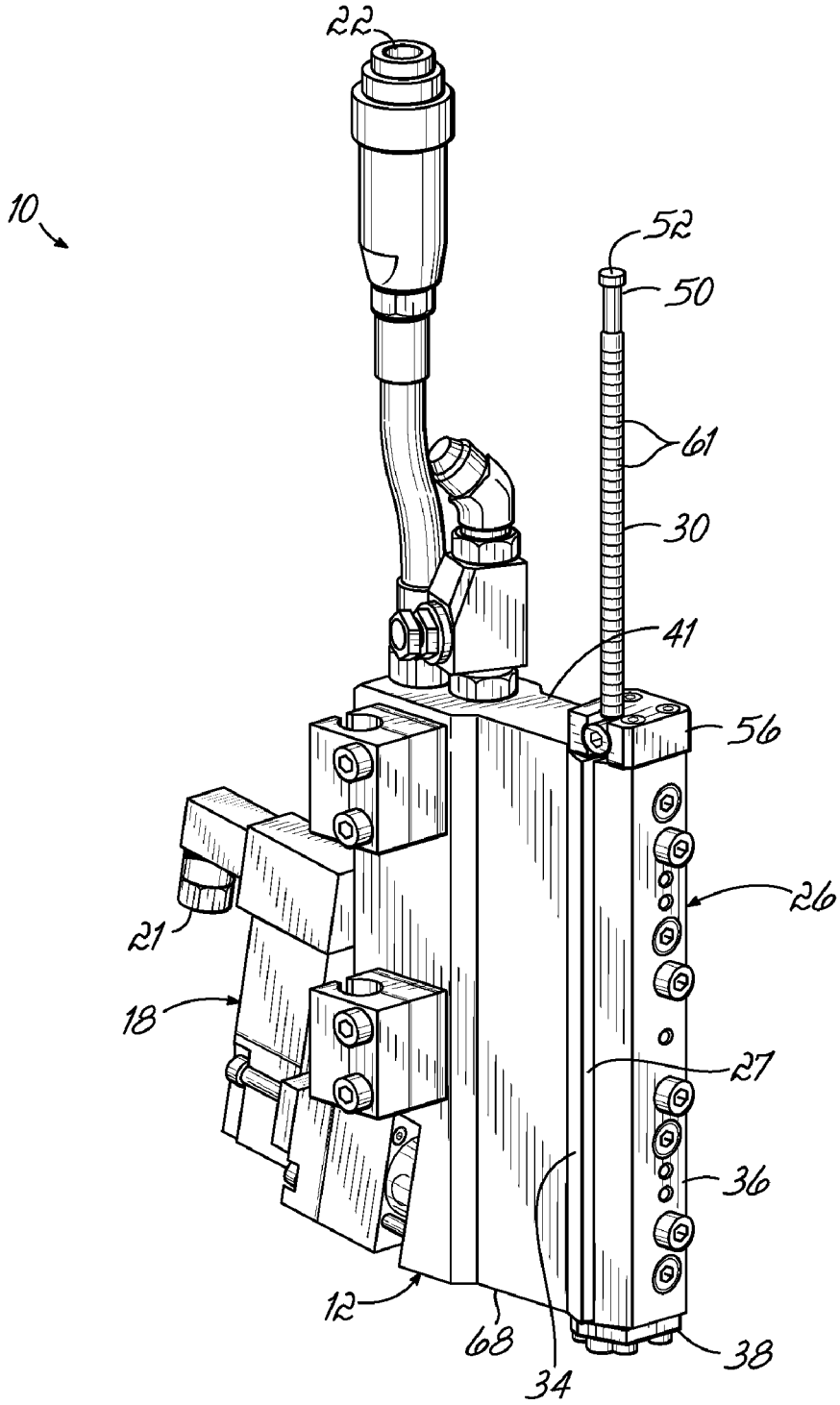
FIG. 2 is a perspective view of the apparatus with the drive device removed, and the piston rod being in the first limit position.

FIG. 2 shows the apparatus 10 according to the invention with the drive device 32 removed. The piston rod is in its first limit position in which the length of the distributor passage 28 which can be acted upon with fluid is at its maximum length. With the drive device 32 removed the piston rod 30 is no longer axially fixed in position by the screwthreaded body 46.

In order to prevent the piston rod 30 from dropping out of the distributor passage 28 even in the situation where the drive device 32 has been removed without the clamping device 56 having been activated the diameter of the bore of the clamping device 56 with which it embraces the piston rod 30 is smaller than the diameter of the closure body 31.

The individual parts of the drive device 32 form an interconnected unit which can be connected as a whole releasably to the main body 12 and/or the nozzle arrangement 26 and the piston rod 30. The drive device 32 can be fixed with only one fixing element, in particular a screw, to the main body 12 and/or to the nozzle arrangement 26.

Figure 3:
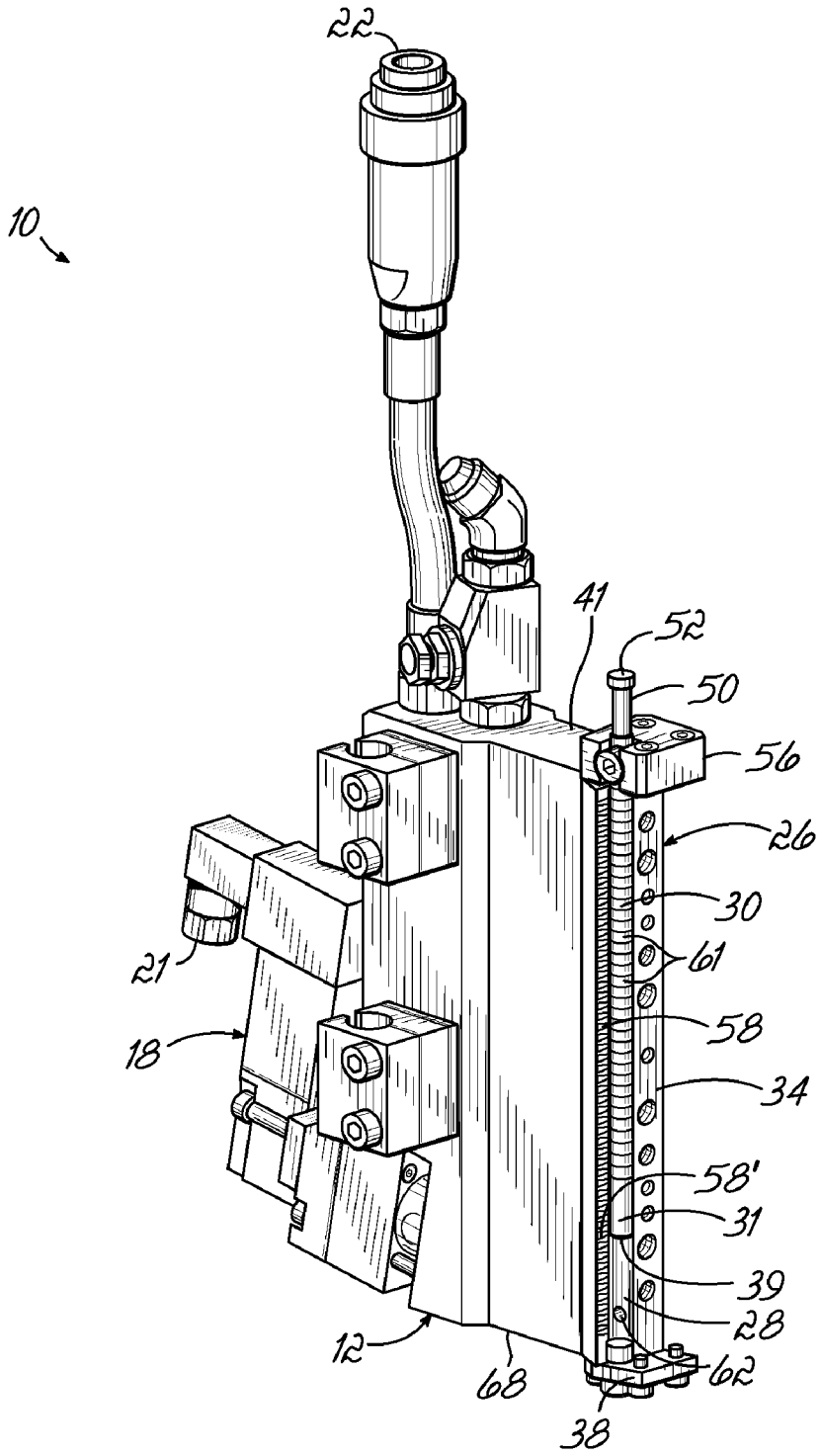
FIG. 3 is a perspective view of the apparatus with a partial block of the nozzle arrangement removed, and the piston rod being in a second limit position.

FIG. 3 shows the apparatus 10 according to the invention with the drive device 32 removed, with the piston rod 30 in its second limit position. In that second limit position, the length of the distributor passage 28 which can be acted upon with fluid is at its minimum. FIG. 3 shows the nozzle arrangement 26 with the second partial block 36 removed in order better to be able to demonstrate the position of the piston rod 30 in the distributor passage 28. In addition it can be seen from FIG. 3 that the nozzle opening communicates with the distributor passage 28 by way of a large number of outlet passages 58. The advantages of that arrangement are described in detail in Utility model specification DE202006014743U1.

When the screwthreaded spindle is rotated by rotation of the latching engagement element 60 a biased ball of the latching engagement element 60 latches perceptibly into a part-spherical recess after a rotary movement of 360°. (see FIG. 1). The pitch of the screwthread of the screwthreaded spindle 44 is so selected that a rotary movement of the screwthreaded spindle 44 through 360° causes axial displacement of the screwthreaded body 46 and thus also of the piston rod 30 by precisely the spacing of two adjacent outlet passages 58. The piston rod 30 includes markings 61 in the form of grooves, the spacing of which precisely corresponds to the spacing of two adjacent outlet passages 58. The markings 61 are so arranged that they are aligned with the top side of the clamping device 56 when the piston rod 30 has been displaced by the correct distance. Thus in addition to the latching engagement element 60 that arrangement provides a certainty that the piston rod 30 is in the correct position and for example the outlet passage 58' adjacent to the first end 39 of the piston rod 30 is not partially closed. The consequence of that would be that an irregular application pattern of adhesive would be produced at the edge region, which is not desirable.

Alternatively the nozzle opening 27 can communicate with the distributor passage 28 over a continuous slot. In that case the length of the distributor passage 28 and the nozzle opening 27, which can be acted upon with fluid, is variable steplessly by the position of the piston rod 30. So that the length of the distributor passage 28 and of the nozzle opening 27, which can be acted upon with fluid, are of equal magnitude and thus the fluid is not uncontrolledly distributed in the slot, a projection is fixed at the end of the piston rod 30, which is in the distributor passage 28. An end of the projection is aligned with the end of the piston rod 30 and extends as far as the nozzle opening 27. That projection seals off the slot and delimits the length of the nozzle opening 27, which can be acted upon with fluid. Such an arrangement can be seen in DE299 08 150 U1.

An end of a through bore 62 can also be seen in FIG. 3. The apparatus 10 is connected to a fluid source (not shown) by way of the hose connection 24. Fluid is conveyed into the apparatus 10 by a conveyor unit (not shown), for example a pump. Adjoining the hose connection 24 is a bore (not shown) which passes through the main body 12 and which extends almost to an underside 68 of the main body 12. A valve needle 64 of the electropneumatically actuable valve 18 engages into that bore and can open or close the bore. Depending on the respective position of the valve needle 64 therefore the flow of fluid is selectively enabled or interrupted. When the bore is opened the fluid flows further along the through bore 62 which opens into the distributor passage 28. The fluid passes into the distributor passage 28 and acts thereon over the length which is predetermined by the piston rod 30. By way of the outlet passages 58 communicating with the distributor passage 28, the fluid goes to the nozzle opening 27 where it leaves the nozzle arrangement 26 and is applied to a substrate (not shown).

Figure 4A:
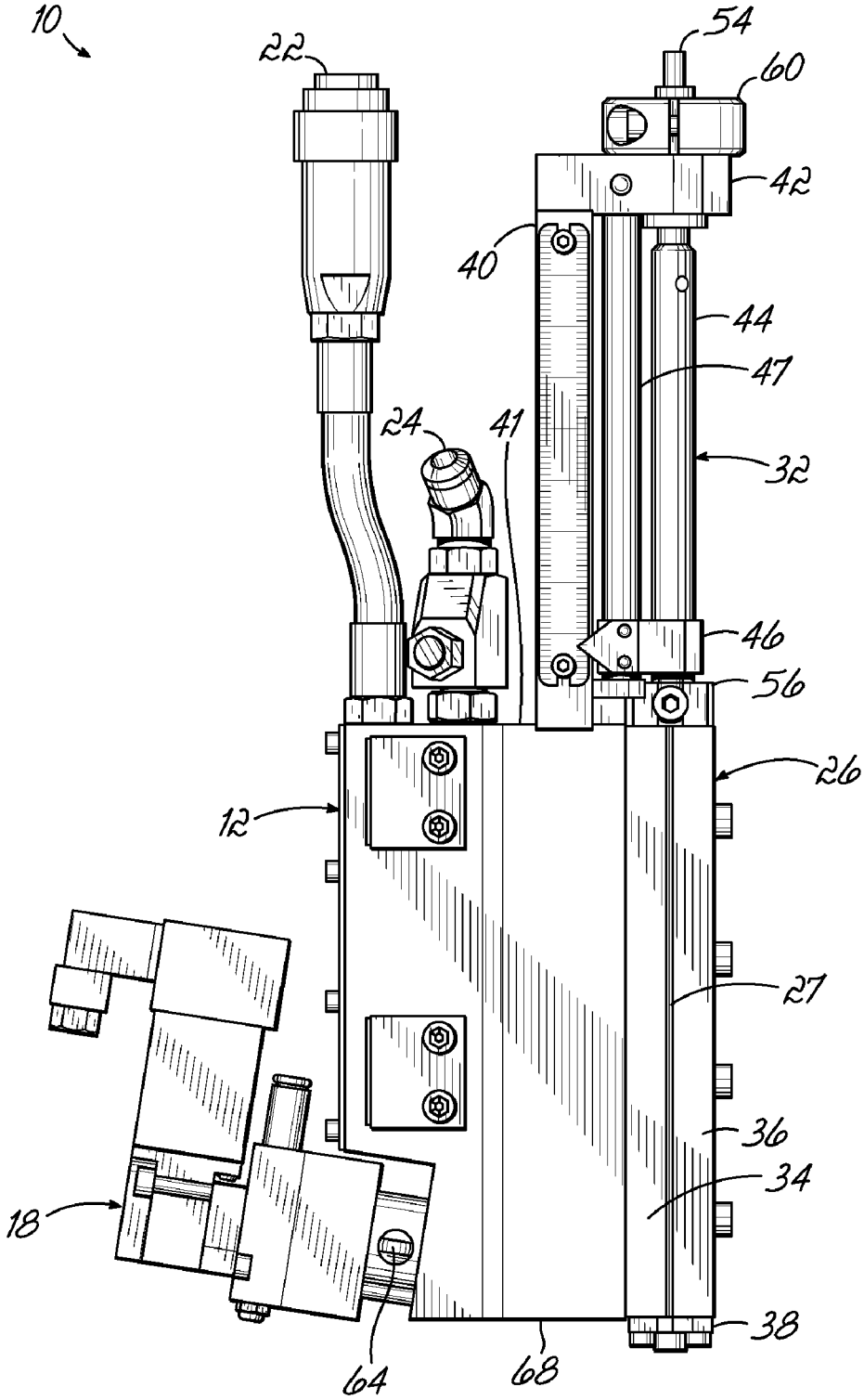
FIG. 4*a* is a side view of the apparatus with the piston rod in a second limit position with the drive device mounted thereto.
Figure 4B:
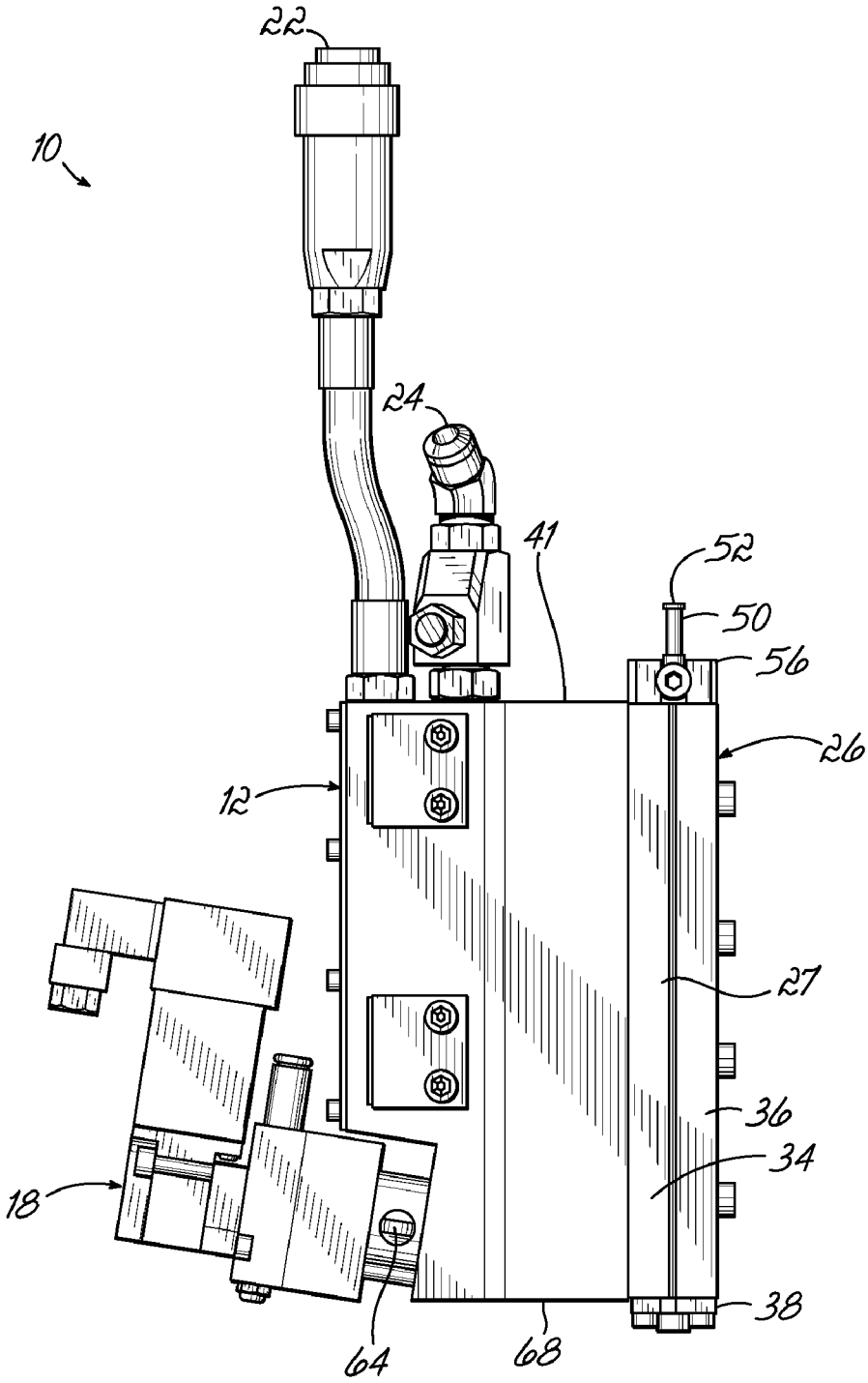
FIG. 4*b* is a side view of the apparatus with the drive device removed.

FIGS. 4*a* and 4*b* show the apparatus 10 according to the invention in such a way that the piston rod 30 is in its second limit position. The drive device 32 is fitted in FIG. 4*a* whereas it has been removed in FIG. 4*b*. The region of the nozzle opening 27 is almost freely accessible when the drive device 32 is removed.

Figure 5:
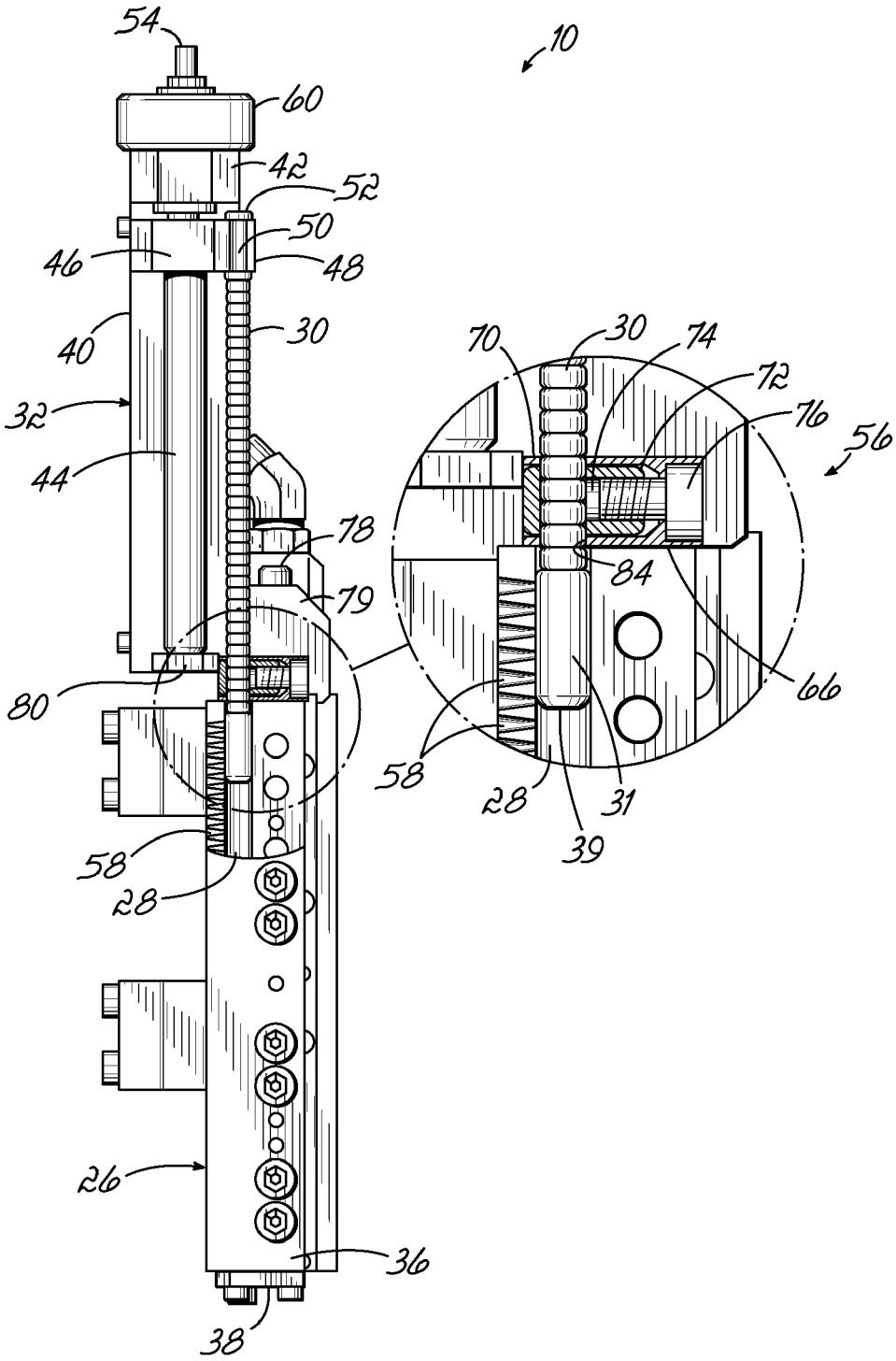
FIG. 5 is a partial section of the apparatus and a view on an enlarged scale of a clamping device.

The clamping device 56 is shown in greater detail in FIG. 5. The clamping device 56 has a housing 66 which is releasably connected to the nozzle arrangement 26 and/or the main body 12. The housing 66 has a U-shaped opening 70 which embraces the piston rod 30. A substantially cylindrical clamping element 72 is arranged movably in a bore 74 extending from the opening 70 into the interior of the housing 66. That clamping element 72 has a perpendicular bore 84 with which it completely embraces the piston rod 30. In addition a female screwthread into which a clamping screw 76 engages is disposed in the clamping element 72. The clamping screw 76 can be rotated by way of a hexagonal socket recess and bears with its head against a base surface of a countersink in the housing 66. Depending on the respective direction in which the clamping screw 76 is rotated the clamping element 72 is moved towards or away from the screw head and thus the piston rod 30 is clamped or released.

After the piston rod 30 has been moved into its desired position the clamping screw 76 is tightened and the piston rod 30 is fixed in its position. The drive device 32 is separated from the main body 12 by releasing only one fixing screw 78. In order to facilitate access to the screw 78 a securing portion 79 is mounted to the holding device 40 of the drive device 32. The screwthreaded body 46 can also be quickly released from the piston rod 30 by the released drive device 32 being moved away from the free end of the opening in the screwthreaded body 46. The diameter of the bore 84 is selected to be smaller than that of the closure body 31. That prevents the piston rod 30 from being able to drop out of the distributor passage 28 if the clamping element 56 cannot fix the piston rod 30, either by virtue of failure of the clamping element 56 or due to incorrect operation, for example if the clamping screw 76 was not tightened or was not adequately tightened. After dismantling of the drive device 32 the nozzle opening is freely accessible, in particular the lateral projection portion 80 which in the assembled condition of the drive device 32 causes difficulty in gaining access to the nozzle opening 27 and thus in substrate guidance is removed.

While the present invention has been illustrated by a description of various embodiments and while these embodiments have been described in some detail, it is not the intention of the Applicant to restrict or in any way limit the scope of the appended claims to such detail. Additional advantages and modifications will readily appear to those skilled in the art. The various features disclosed herein may be used alone or in any combination depending on the needs and preferences of the user. The scope of the invention itself should only be defined by the appended claims.

What is claimed is:

1. An apparatus for applying a fluid to a substrate, comprising:

a main body including a fluid feed passage connectable to a fluid source;

a nozzle arrangement coupled to the main body, the nozzle arrangement including a substantially slot-shaped nozzle opening and a distributor passage in fluid communication with the fluid feed passage and the nozzle opening;

a piston rod including a first end disposed within the distributor passage and a second end positioned outside the nozzle arrangement, the piston rod mounted for translation within the distributor passage to adjust an effective length of the distributor passage along which the fluid is directed through the nozzle opening; and a clamping device coupled to the nozzle arrangement, the clamping device including a housing, a U-shaped opening in the housing configured to receive the piston rod, a first bore in the housing, a clamping element positioned at least partially within the first bore, the clamping element including a second bore perpendicular to the first bore and configured to receive the piston rod, and a clamping screw in the first bore and engaged with the clamping element, the clamping screw configured to move the clamping element within the first bore and thereby selectively engage and disengage the piston rod to respectively prevent and allow translational movement of the piston rod in the distributor passage.

2. The apparatus of claim 1, wherein the first end of the piston rod includes a closure body having a first diameter, and the second bore has a second diameter smaller than the first diameter to prevent the closure body from being removed from the distributor passage and the nozzle arrangement while the clamping device is coupled to the nozzle arrangement.

3. The apparatus of claim 1, wherein the clamping device is removably coupled to the nozzle arrangement.

4. The apparatus of claim 1, wherein the nozzle opening includes a plurality of outlet passages in communication with the distributor passage, the first end of the piston rod includes a closure body configured to occlude a portion of the outlet passages depending on the position of the piston rod within the distributor passage, the clamping device further including an upper surface, and the piston rod includes markings configured to align with the upper surface of the clamping device when the first end of the piston rod is positioned between two of the outlet passages.

5. The apparatus of claim 1, further comprising:

a drive device removably coupled to the main body and configured to engage the piston rod adjacent the second end, the drive device including a holding device configured to be coupled to the main body, a screwthreaded spindle on the holding device, and a screwthreaded body configured to engage the screwthreaded spindle and the piston rod, the screwthreaded body operable to convert rotational movement of the screwthreaded spindle into translational movement of the piston rod.

6. The apparatus of claim 5, wherein the piston rod includes a reduced-diameter portion adjacent the second end, and the screwthreaded body includes a recess configured to engage the reduced-diameter portion for translational movement therewith.

7. The apparatus of claim 6, wherein the holding device, the screwthreaded spindle, and the screwthreaded body are configured as an interconnected unit coupled to the main body by a single fastener and that may be removed from the main body by disengaging the single fastener and disengaging the recess of the screwthreaded body from the piston rod.

8. The apparatus of claim 5, wherein the nozzle opening includes a plurality of outlet passages in communication with the distributor passage;

wherein the first end of the piston rod includes a closure body configured to occlude a portion of the outlet passages depending on the position of the piston rod within the distributor passage; and wherein the drive device further includes a latching engagement element operatively coupled to the screwthreaded spindle and configured to encourage the screwthreaded spindle to stop in a rotational position such that the first end of the piston rod is positioned between two outlet passages.

9. The apparatus of claim 8, wherein the clamping device includes an upper surface and the piston rod includes markings configured to align with the upper surface of the clamping device when the first end of the piston rod is positioned between two outlet passages.

10. The apparatus of claim 5, wherein the drive device further includes a lateral projection portion projecting outwardly with respect to the main body, the lateral projection portion configured to be oriented in the same direction as the nozzle opening or an opposite direction as the nozzle opening.

* * * * *